US010731939B2

(12) United States Patent
Na et al.

(10) Patent No.: US 10,731,939 B2
(45) Date of Patent: Aug. 4, 2020

(54) FIREARM MUZZLE DEVICE

(71) Applicant: Strike Industries, Inc., Santa Ana, CA (US)

(72) Inventors: Jonathon Na, Westminster, CA (US); David Hyung Chin, Irvine, CA (US)

(73) Assignee: STRIKE INDUSTRIES, INC., Santa Ana, CA (US)

( * ) Notice: Subject to any disclaimer, the term of this patent is extended or adjusted under 35 U.S.C. 154(b) by 0 days.

(21) Appl. No.: 16/181,742

(22) Filed: Nov. 6, 2018

(65) Prior Publication Data

US 2020/0141681 A1 May 7, 2020

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 25/00
USPC ..... 89/14.3
See application file for complete search history.

(56) References Cited

U.S. PATENT DOCUMENTS 4,207,799 A * 6/1980 Tocco ..... F41A 21/325 89/14.3
4,709,497 A * 12/1987 Resca ..... F41A 21/32 42/7
6,742,297 B2 * 6/2004 Lakatos ..... F41A 21/36 42/1.06
10,156,412 B1 * 12/2018 Price ..... F41A 21/36
2003/0200692 A1 * 10/2003 Lakatos ..... F41A 21/36 42/1.06

OTHER PUBLICATIONS

"Strike Industries G4 Slide Comp Review: No Threaded Barrels!!" by Tactical Toolbox on Jun. 4, 2017, https://www.youtube.com/watch?v=geiyM0veTBA (Year: 2017).*

* cited by examiner

*Primary Examiner* — Samir Abdosh
(74) *Attorney, Agent, or Firm* — Han IP PLLC; Andy M. Han

(57) ABSTRACT

An apparatus implementable on a pistol includes a compensator and a guide rod. The guide rod has a front distal end and a rear distal end opposite the front distal end. The compensator includes a muzzle brake having a recoil-reduction device, a first through hole and a second through hole. When the compensator is implemented on the pistol: (a) the recoil-reduction device redirects propellant gases to counter a recoil force upon firing of a round of ammunition by the pistol; (b) the first through hole is aligned with a barrel of the pistol to allow firing of the round of ammunition, and (c) the second through hole receives the front distal end of the guide rod therein such that an interface between the guide rod, the muzzle brake and a slide of the pistol is keyed to prevent rotation of the guide rod.

19 Claims, 3 Drawing Sheets

FIREARM MUZZLE DEVICE

TECHNICAL FIELD

The present disclosure is generally related to firearms and, more particularly, to a firearm muzzle device.

BACKGROUND

Unless otherwise indicated herein, approaches described in this section are not prior art to the claims listed below and are not admitted as prior art by inclusion in this section.

A muzzle brake or recoil compensator is a muzzle device mounted on, threaded on or otherwise connected to a muzzle of a firearm. One main function of a muzzle device is to redirect propellant gases to counter recoil and muzzle rise so as to allow better or quicker follow-up shots. However, many existing muzzle devices on the market tend to require significant modification and/or replacement of parts, or are otherwise integral to a proprietary system not allowing flexibility in customization.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In one aspect, an apparatus implementable on a pistol may include a guide rod and a compensator. The guide rod may have a front distal end and a rear distal end opposite the front distal end. The compensator may include muzzle brake having a recoil-reduction device, a first through hole and a second through hole. When the compensator is implemented on the pistol: (a) the recoil-reduction device may redirect propellant gases to counter a recoil force upon firing of a round of ammunition by the pistol; (b) the first through hole may be aligned with a barrel of the pistol to allow firing of the round of ammunition, and (c) the second through hole may receive the front distal end of the guide rod therein such that an interface between the guide rod, the muzzle brake and a slide of the pistol is keyed to prevent rotation of the guide rod.

In one aspect, an apparatus implementable on a pistol may include a compensator having muzzle brake with a front side and a rear side that is opposite the front side and facing the pistol when the compensator is implemented on the pistol. The muzzle brake may include a recoil-reduction device, a first through hole and a second through hole. The recoil-reduction device may be configured to redirect propellant gases to counter a recoil force upon firing of a round of ammunition by the pistol. The first through hole may communicatively connect the front side and the second side. The first through hole may include a first front opening on the front size of the muzzle brake and a first rear opening on the rear size of the muzzle brake. The first rear opening may be larger than the first front opening and may be configured to receive a muzzle of a barrel of the pistol when the compensator is implemented on the pistol. The second through hole may communicatively connect the front side and the second side. The second through hole may include a second front opening on the front size of the muzzle brake and a second rear opening on the rear size of the muzzle brake. The second rear opening may be smaller than the second front opening and may be configured to receive a front distal end of a guide rod of the pistol when the compensator is implemented on the pistol.

In one aspect, an apparatus may include a pistol and a compensator. The pistol may include a frame, a slide glidingly mounted on the frame, a guide rod received in the slide, a barrel received in the slide, a magazine configured to contain at least one round of ammunition therein, and a firing mechanism configured to cause firing of the at least one round of ammunition. The guide rod may have a front distal end and a rear distal end opposite the front distal end. The compensator may be receivable at a muzzle of the barrel of the pistol, the compensator comprising a muzzle brake. The muzzle brake may include a recoil-reduction device, a first through hole, and a second through hole. When the compensator is implemented on the pistol: (a) the recoil-reduction device redirects propellant gases to counter a recoil force upon firing of a round of ammunition by the pistol; (b) the first through hole is aligned with a barrel of the pistol to allow firing of the round of ammunition; and (c) the second through hole receives the front distal end of the guide rod therein such that an interface between the guide rod, the muzzle brake and a slide of the pistol is keyed to prevent rotation of the guide rod.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
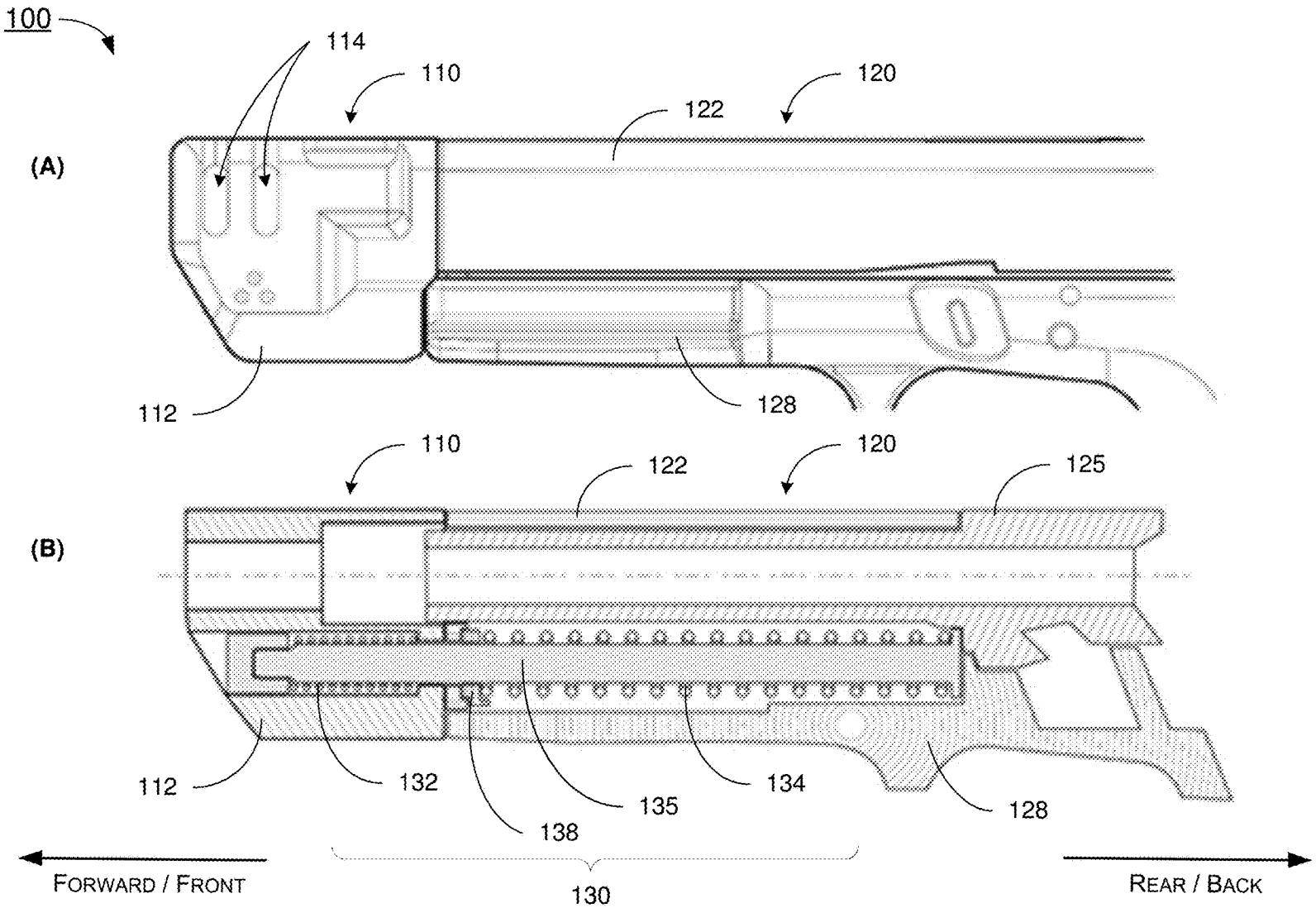
FIG. 1 is a diagram of a side view of a pistol with a compensator at rest in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
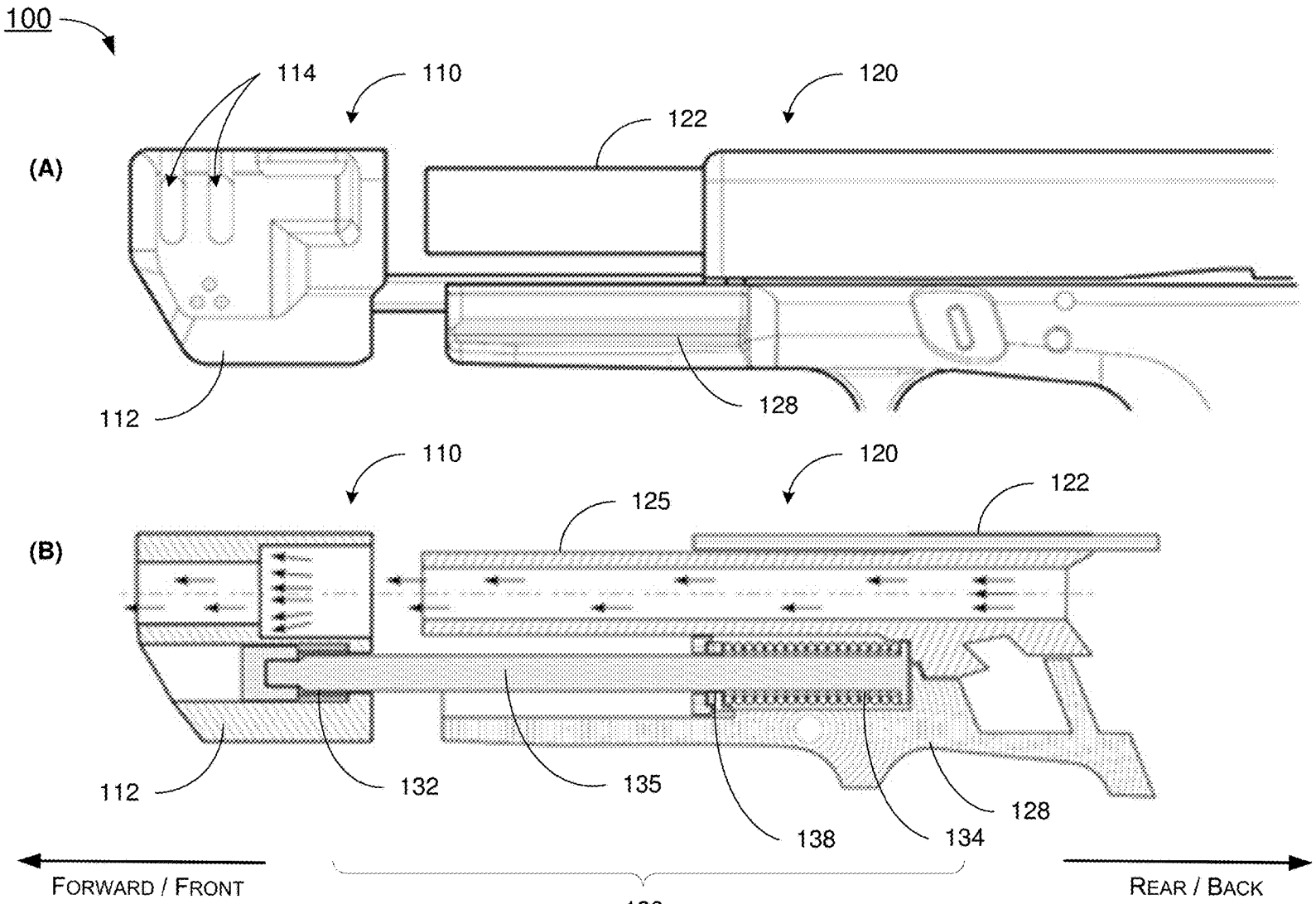
FIG. 2 is a diagram of a side view of a pistol with a compensator in operation in accordance with an implementation of the present disclosure.
Figure 3:
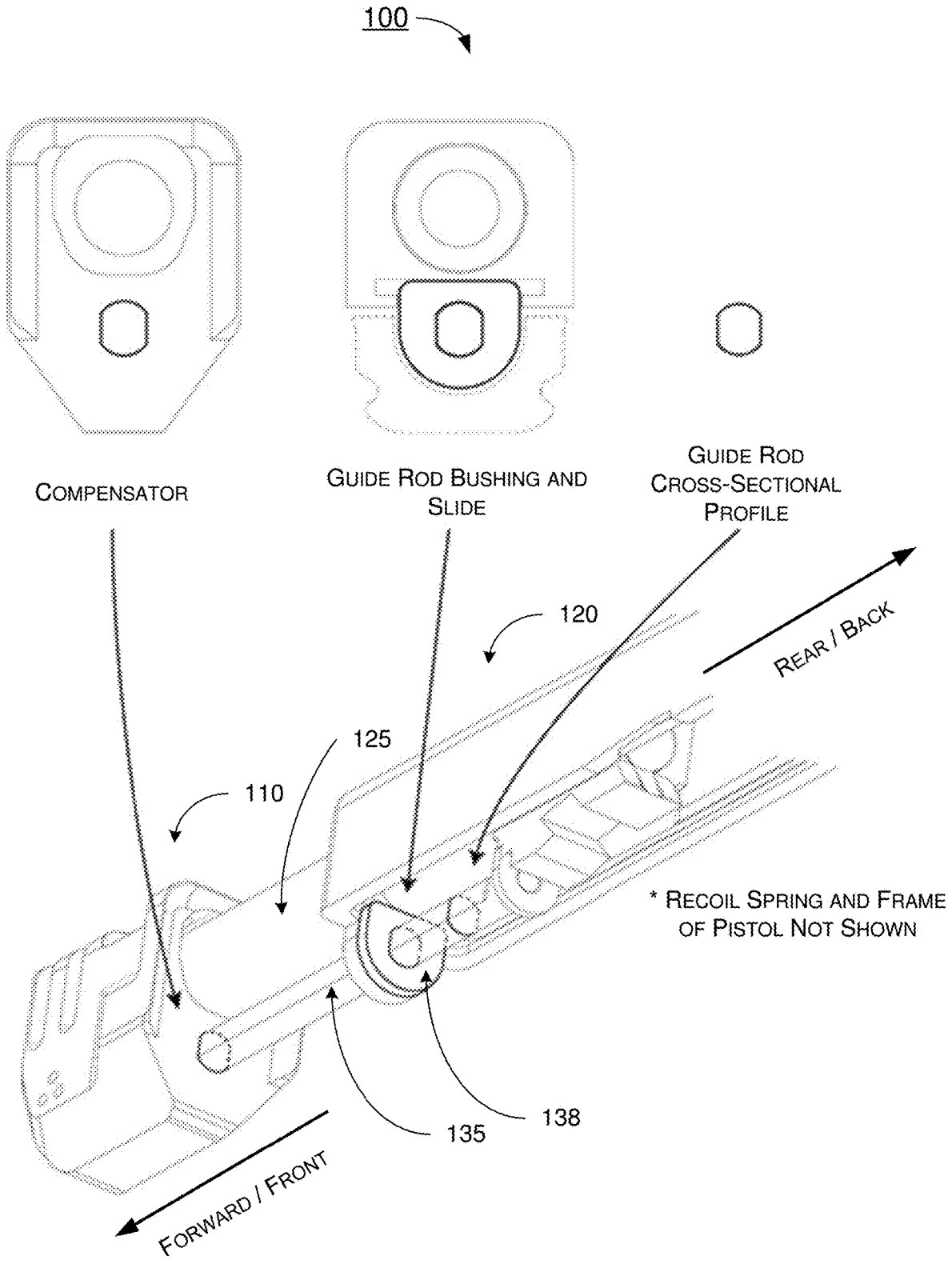
FIG. 3 is a diagram of a perspective view of a pistol with a compensator in accordance with an implementation of the present disclosure.

FIG. 1~FIG. 3 illustrate various views of an apparatus 100 including a compensator 110 and a pistol 120. in accordance with an implementation of the present disclosure. Referring to FIG. 1~FIG. 3, compensator 110 may include a muzzle brake 112 and a recoil-reduction device 114 having at least one surface for propellant gases to act upon, thereby reducing recoil. Pistol 120 may include a slide 122, a barrel 125, a frame 128 and a guide rod assembly 130. Guide rod assembly 130 may include a guide rod 135, a returning mechanism 132, a recoil spring 134 and a guide rod bushing 138. In the example shown in FIG. 1~FIG. 3, recoil-reduction device 114 has at least one baffle opening on each of a left side and a right side of muzzle brake 112. In other designs, recoil-reduction device 114 may include one or more porting holes to redirect the propellent gases, thereby reducing recoil.

FIG. 1 shows apparatus 100 at rest. FIG. 2 shows apparatus 100 in operation at a time immediately after firing of a cartridge or round of ammunition. Compensator 110 is at a rest position with its rear side in direct contact with a front surface of slide 122 and/or a front surface of frame 128. As shown in FIG. 2, gasses from explosion of gun powder of the cartridge image on surfaces within compensator 110 perpendicular to a direction of bore axis of barrel 125. The force of impingement propels compensator 110 to move forward as slide 122 is propelled to move rearward by recoil force. After gas pressure drops sufficiently, returning mechanism 132 forces compensator 110 to move rearward and toward pistol 120 into its rest position as slide 122 closes. FIG. 3 shows that guide rod bushing 138 is designed with a lug that is shaped to mate with a bottom surface of barrel 125 to prevent rotation of guide rod assembly 130. Moreover, an interface between guide rod bushing 138 and muzzle brake 112 may be keyed so as to provide an anti-rotation feature to prevent rotation of guide rod assembly 130.

When installed, mounted or otherwise implemented on pistol 120, compensator 110 may operate in two ways. Firstly, upon firing of a cartridge or round of ammunition by pistol 120, gasses and other ejecta resulting from the firing of the round impinge on baffles, porting holes or propellant gas-redirecting surface(s) of compensator 110, thereby producing a force counter to a recoil force to reduce, minimize or otherwise mitigate the recoil force. Secondly, compensator 110 may be driven along an extended guide rod to reciprocate counter cyclically to a motion of a slide 122 of pistol 120. This mass of compensator 110 moving in a vector opposing the motion of slide 122 of pistol 120 (or other operating system) further mitigates recoil by reducing net rearward force caused by the momentum of slide 122 (or other operating system). Advantageously, with the design in accordance with the present disclosure returning mechanism 132 can help retain compensator 110 and guide rod assembly 130 in battery. Return mechanism 132 may be implemented with a wire, a hydraulic spring, a gas spring, a hydraulic dampener, a gas dampener, a hydraulic piston, or a gas piston. In some implementations, a tip of the front distal end of the guide rod 135 includes a flange such that returning mechanism 132 is compressed between the flange and an inner wall of the second through hole on the rear side of muzzle brake 132 upon firing of a round of ammunition by the pistol when compensator 110 is implemented on the pistol.

Additionally, a keyed interface between guide rod 135, guide rod bushing 138, slide 122, and compensator 110 can help prevent rotation of guide rod 135. Moreover, there may be a lug mated to a bottom surface of barrel 125 to help prevent rotation of guide rod assembly 130. Accordingly, numerous benefits are provided by the design in accordance with the present disclosure. For instance, recoil may be reduced by redirection of muzzle gasses as well as mechanical cancellation of recoil impulse. Additionally, the proposed design does not require permanent modification to the host firearm platform (e.g., pistol). Also, the proposed design can be readily adopted to nearly any firearm platform. Moreover, the proposed design provides increased reliability by not adding weight to operating components (e.g., barrel, breach assembly and slide of the firearm). Furthermore, the mounting components can be adapted as appropriate to use with any host platform. That is, the guide rod assembly, guide rod bushing, returning mechanism, shape of the compensator and other features of the proposed design may be adapted to suit a given firearm. For instance, geometric shape of one or more components of the proposed design may be changed as appropriate or to incorporate certain handling characteristics. Moreover, the material of compensator 110 and supporting components are made with sufficient strength and hardness to withstand recoil energy and abrasion effects by gas and ejecta of a fired cartridge.

Highlight of Select Features

In one aspect, an apparatus implementable on a pistol may include a guide rod and a compensator. The guide rod may be receivable in a slide of the pistol, and the guide rod may have a front distal end and a rear distal end opposite the front distal end. The compensator may include a muzzle brake, which may include a recoil-reduction device, a first through hole and a second through hole. When the compensator is implemented on the pistol: (a) the recoil-reduction device may redirect propellant gases to counter a recoil force upon firing of a round of ammunition by the pistol; (b) the first through hole may be aligned with a barrel of the pistol to allow firing of the round of ammunition; and (c) the second through hole may receive the front distal end of the guide rod therein such that an interface between the guide rod, the muzzle brake and a slide of the pistol is keyed to prevent rotation of the guide rod.

In some implementations, the muzzle brake may include a front side and a rear side that is opposite the front side and facing the pistol when the compensator is implemented on the pistol. Additionally, the baffle device may include: at least one baffle opening disposed on the muzzle brake between the front side and the rear side, at least one porting hole disposed on the muzzle brake between the front side and the rear side, or at least one surface for propellant gases to act upon.

In some implementations, the muzzle brake may include a front side and a rear side that is opposite the front side and facing the pistol when the compensator is implemented on the pistol. Moreover, the first through hole may communicatively connect the front side and the second side. The first through hole may include: (1) a first front opening on the front size of the muzzle brake; and (2) a first rear opening on the rear size of the muzzle brake, the first rear opening larger than the first front opening and configured to receive a muzzle of a barrel of the pistol when the compensator is implemented on the pistol.

In some implementations, the muzzle brake may include a front side and a rear side that is opposite the front side and facing the pistol when the compensator is implemented on the pistol. Additionally, the second through hole may communicatively connect the front side and the second side. The second through hole may include: (1) a second front opening on the front size of the muzzle brake; and (2) a second rear opening on the rear size of the muzzle brake, the second rear opening smaller than the second front opening and configured to receive the front distal end of the guide rod when the compensator is implemented on the pistol.

In some implementations, a shape of the second rear opening may be non-circular.

In some implementations, the apparatus may also include a returning mechanism received in the second through hole of the muzzle brake and disposed around the front distal end of the guide rod. In some implementations, a tip of the front distal end of the guide rod may include a flange such that the returning mechanism is compressed between the flange and an inner wall of the second through hole on the rear side of the muzzle brake upon firing of a round of ammunition by the pistol when the compensator is implemented on the pistol.

In some implementations, the apparatus may also include a recoil spring received in a slide of the pistol when the compensator is implemented on the pistol and disposed around the guide rod. In some implementations, a tip of the rear distal end of the guide rod may include a flange such that the recoil spring is compressed between the flange and an inner wall of the slide upon firing of a round of ammunition by the pistol.

In some implementations, the apparatus may also include a guide rod bushing received in the slide of the pistol when the compensator is implemented on the pistol and disposed around the guide rod. In some implementations, a cross-sectional profile of an opening of the guide rod bushing may be non-circular. Moreover, the guide rod bushing may include a lug shaped to mate with a bottom surface of the barrel to prevent rotation of the guide rod.

In one aspect, an apparatus implementable on a pistol may include a compensator. The compensator may include a muzzle brake having a front side and a rear side that is opposite the front side and facing the pistol when the compensator is implemented on the pistol. The muzzle brake may include a recoil-reduction device, a first through hole and a second through hole. The recoil-reduction device may be configured to redirect propellant gases to counter a recoil force upon firing of a round of ammunition by the pistol. The first through hole may communicatively connect the front side and the second side. The first through hole may include: (1) a first front opening on the front size of the muzzle brake; and (2) a first rear opening on the rear size of the muzzle brake. The first rear opening may be larger than the first front opening and may be configured to receive a muzzle of a barrel of the pistol when the compensator is implemented on the pistol. The second through hole may communicatively connect the front side and the second side. The second through hole may include: (1) a second front opening on the front size of the muzzle brake; and (2) a second rear opening on the rear size of the muzzle brake. The second rear opening may be smaller than the second front opening and configured to receive a front distal end of a guide rod of the pistol when the compensator is implemented on the pistol.

In some implementations, a shape of the second rear opening may be non-circular.

In some implementations, the recoil-reduction device may include: at least one baffle opening disposed on the muzzle brake between the front side and the rear side, at least one porting hole disposed on the muzzle brake between the front side and the rear side, or at least one surface for propellant gases to act upon.

In some implementations, the apparatus may also include a guide rod having a front distal end and a rear distal end opposite the front distal end. In some implementations, a cross-sectional profile of the guide rod may be non-circular. Moreover, when the compensator is implemented on the pistol, the front distal end of the guide rod may be received in the second through hole of the muzzle brake.

In some implementations, the apparatus may also include a returning mechanism received in the second through hole of the muzzle brake and disposed around the front distal end of the guide rod. In some implementations, a tip of the front distal end of the guide rod may include a flange such that the returning mechanism is compressed between the flange and an inner wall of the second through hole on the rear side of the muzzle brake upon firing of the round of ammunition by the pistol when the compensator is implemented on the pistol.

In some implementations, the apparatus may also include a recoil spring received in a slide of the pistol when the compensator is implemented on the pistol and disposed around the guide rod. In some implementations, a tip of the rear distal end of the guide rod may include a flange such that the recoil spring is compressed between the flange and an inner wall of the slide upon firing of a round of ammunition by the pistol.

In some implementations, the apparatus may also include a guide rod bushing received in the slide of the pistol when the compensator is implemented on the pistol and disposed around the guide rod. In some implementations, a cross-sectional profile of an opening of the guide rod bushing may be non-circular. Moreover, the guide rod bushing may include a lug shaped to mate with a bottom surface of the barrel to prevent rotation of the guide rod.

In one aspect, an apparatus may include a pistol and a compensator. The pistol may include a frame, a slide glidingly mounted on the frame, a guide rod received in the slide, a barrel received in the slide, a magazine configured to contain at least one round of ammunition therein, and a firing mechanism configured to cause firing of the at least one round of ammunition. The guide rod may have a front distal end and a rear distal end opposite the front distal end. The compensator may be receivable at a muzzle of the barrel of the pistol. The compensator may include a muzzle brake, which may include a recoil-reduction device, a first through hole, and a second through hole. When the compensator is implemented on the pistol: (a) the recoil-reduction device may redirect propellant gases to counter a recoil force upon firing of a round of ammunition by the pistol, (b) the first through hole may be aligned with a barrel of the pistol to allow firing of the round of ammunition, and (c) the second through hole may receive the front distal end of the guide rod therein such that an interface between the guide rod, the muzzle brake and a slide of the pistol is keyed to prevent rotation of the guide rod.

In some implementations, the muzzle brake may include a front side and a rear side that is opposite the front side and facing the pistol when the compensator is implemented on the pistol. The recoil-reduction device may include: at least one baffle opening disposed on the muzzle brake between the front side and the rear side, at least one porting hole disposed on the muzzle brake between the front side and the rear side, or at least one surface for propellant gases to act upon.

In some implementations, the muzzle brake may include a front side and a rear side that is opposite the front side and facing the pistol when the compensator is implemented on the pistol. In some implementations, the first through hole may communicatively connect the front side and the second side. The first through hole may include: (1) a first front opening on the front size of the muzzle brake; and (2) a first rear opening on the rear size of the muzzle brake. The first rear opening may be larger than the first front opening and may be configured to receive a muzzle of a barrel of the pistol when the compensator is implemented on the pistol.

In some implementations, the muzzle brake may include a front side and a rear side that is opposite the front side and facing the pistol when the compensator is implemented on the pistol. In some implementations, the second through hole may communicatively connect the front side and the second side. The second through hole may include: (1) a second front opening on the front size of the muzzle brake; and (2) a second rear opening on the rear size of the muzzle brake. The second rear opening may be smaller than the second front opening and configured to receive the front distal end of the guide rod when the compensator is implemented on the pistol. In some implementations, a shape of the second rear opening may be non-circular.

In some implementations, the apparatus may also include a returning mechanism, a recoil spring and a guide rod bushing. The returning mechanism may be received in the second through hole of the muzzle brake and disposed around the front distal end of the guide rod. The recoil spring may be received in a slide of the pistol when the compensator is implemented on the pistol and disposed around the guide rod. The guide rod bushing may be received in the slide of the pistol when the compensator is implemented on the pistol and disposed around the guide rod. In some implementations, a tip of the front distal end of the guide rod may include a front flange such that the returning mechanism is compressed between the front flange and an inner wall of the second through hole on the rear side of the muzzle brake upon firing of a round of ammunition by the pistol when the compensator is implemented on the pistol. In some implementations, a tip of the rear distal end of the guide rod may include a rear flange such that the recoil spring is compressed between the rear flange and an inner wall of the slide upon firing of a round of ammunition by the pistol. In some implementations, a cross-sectional profile of an opening of the guide rod bushing may be non-circular. In some implementations, the guide rod bushing may include a lug shaped to mate with a bottom surface of the barrel to prevent rotation of the guide rod.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a pistol, comprising:

a guide rod receivable in a slide of the pistol, the guide rod having a front distal end and a rear distal end opposite the front distal end;

a compensator comprising a muzzle brake, the muzzle brake comprising a recoil-reduction device, a first through hole and a second through hole, wherein, when the compensator is implemented on the pistol:

the recoil-reduction device is configured to redirect propellant gases to counter a recoil force upon firing of a round of ammunition by the pistol, the first through hole is aligned with a barrel of the pistol to allow firing of the round of ammunition, and the second through hole is configured to receive the front distal end of the guide rod therein such that an interface between the guide rod, the muzzle brake and a slide of the pistol is keyed to prevent rotation of the guide rod; and a returning mechanism received in the second through hole of the muzzle brake and disposed around the front distal end of the guide rod.

2. The apparatus of claim 1, wherein the muzzle brake comprises a front side and a rear side that is opposite the front side and facing the pistol when the compensator is implemented on the pistol, and wherein the recoil-reduction device comprises:

at least one baffle opening disposed on the muzzle brake between the front side and the rear side;

at least one porting hole disposed on the muzzle brake between the front side and the rear side; or at least one surface for propellant gases to act upon.

3. The apparatus of claim 1, wherein the muzzle brake comprises a front side and a rear side that is opposite the front side and facing the pistol when the compensator is implemented on the pistol, wherein the first through hole communicatively connects the front side and the second side, and wherein the first through hole comprises:

a first front opening on the front size of the muzzle brake; and a first rear opening on the rear size of the muzzle brake, the first rear opening larger than the first front opening and configured to receive a muzzle of a barrel of the pistol when the compensator is implemented on the pistol.

4. The apparatus of claim 1, wherein the muzzle brake comprises a front side and a rear side that is opposite the front side and facing the pistol when the compensator is implemented on the pistol, wherein the second through hole communicatively connects the front side and the second side, and wherein the second through hole comprises:

a second front opening on the front size of the muzzle brake; and a second rear opening on the rear size of the muzzle brake, the second rear opening smaller than the second front opening and configured to receive the front distal end of the guide rod when the compensator is implemented on the pistol, wherein a shape of the second rear opening is non-circular.

5. The apparatus of claim 1, wherein the returning mechanism comprises a wire, a hydraulic spring, a gas spring, a hydraulic dampener, a gas dampener, a hydraulic piston, or a gas piston.

6. The apparatus of claim 1, wherein a tip of the front distal end of the guide rod includes a flange such that the returning mechanism is compressed between the flange and an inner wall of the second through hole on the rear side of the muzzle brake upon firing of a round of ammunition by the pistol when the compensator is implemented on the pistol.

7. The apparatus of claim 1, further comprising:

a recoil spring received in a slide of the pistol when the compensator is implemented on the pistol and disposed around the guide rod; and a guide rod bushing received in the slide of the pistol when the compensator is implemented on the pistol and disposed around the guide rod, wherein a tip of the rear distal end of the guide rod includes a flange such that the recoil spring is compressed between the flange and an inner wall of the slide upon firing of a round of ammunition by the pistol, wherein a cross-sectional profile of an opening of the guide rod bushing is non-circular, and wherein the guide rod bushing includes a lug shaped to mate with a bottom surface of the barrel to prevent rotation of the guide rod.

8. An apparatus implementable on a pistol, comprising:

a compensator comprising a muzzle brake having a front side and a rear side that is opposite the front side and facing the pistol when the compensator is implemented on the pistol, the muzzle brake comprising:

a recoil-reduction device configured to redirect propellant gases to counter a recoil force upon firing of a round of ammunition by the pistol;

a first through hole communicatively connecting the front side and the second side, the first through hole comprising:

a first front opening on the front size of the muzzle brake; and a first rear opening on the rear size of the muzzle brake, the first rear opening larger than the first front opening and configured to receive a muzzle of a barrel of the pistol when the compensator is implemented on the pistol; and a second through hole communicatively connecting the front side and the second side, the second through hole comprising:

a second front opening on the front size of the muzzle brake; and a second rear opening on the rear size of the muzzle brake, the second rear opening smaller than the second front opening and configured to receive a front distal end of a guide rod of the pistol when the compensator is implemented on the pistol, wherein a shape of the second rear opening is non-circular.

9. The apparatus of claim 8, wherein the recoil-reduction device comprises:

at least one baffle opening disposed on the muzzle brake between the front side and the rear side;

at least one porting hole disposed on the muzzle brake between the front side and the rear side; or at least one surface for propellant gases to act upon.

10. The apparatus of claim 8, further comprising:

a guide rod having a front distal end and a rear distal end opposite the front distal end, a cross-sectional profile of the guide rod being non-circular, wherein, when the compensator is implemented on the pistol, the front distal end of the guide rod is received in the second through hole of the muzzle brake.

11. The apparatus of claim 10, further comprising:

a returning mechanism received in the second through hole of the muzzle brake and disposed around the front distal end of the guide rod.

12. The apparatus of claim 11, wherein the returning mechanism comprises a wire, a hydraulic spring, a gas spring, a hydraulic dampener, a gas dampener, a hydraulic piston, or a gas piston.

13. The apparatus of claim 11, wherein a tip of the front distal end of the guide rod includes a flange such that the returning mechanism is compressed between the flange and an inner wall of the second through hole on the rear side of the muzzle brake upon firing of a round of ammunition by the pistol when the compensator is implemented on the pistol.

14. The apparatus of claim 10, further comprising:

a recoil spring received in a slide of the pistol when the compensator is implemented on the pistol and disposed around the guide rod; and a guide rod bushing received in the slide of the pistol when the compensator is implemented on the pistol and disposed around the guide rod, wherein a tip of the rear distal end of the guide rod includes a flange such that the recoil spring is compressed between the flange and an inner wall of the slide upon firing of a round of ammunition by the pistol, wherein a cross-sectional profile of an opening of the guide rod bushing is non-circular, and wherein the guide rod bushing includes a lug shaped to mate with a bottom surface of the barrel to prevent rotation of the guide rod.

15. An apparatus, comprising:

a pistol comprising:

a frame;

a slide glidingly mounted on the frame;

a guide rod received in the slide, the guide rod having a front distal end and a rear distal end opposite the front distal end;

a barrel received in the slide;

a magazine configured to contain at least one round of ammunition therein; and a firing mechanism configured to cause firing of the at least one round of ammunition;

a compensator receivable at a muzzle of the barrel of the pistol, the compensator comprising a muzzle brake, the muzzle brake comprising:

a recoil-reduction device;

a first through hole; and a second through hole, wherein, when the compensator is implemented on the pistol:

the recoil-reduction device is configured to redirect propellant gases to counter a recoil force upon firing of a round of ammunition by the pistol, the first through hole is aligned with a barrel of the pistol to allow firing of the round of ammunition, and the second through hole is configured to receive the front distal end of the guide rod therein such that an interface between the guide rod, the muzzle brake and a slide of the pistol is keyed to prevent rotation of the guide rod; and a returning mechanism received in the second through hole of the muzzle brake and disposed around the front distal end of the guide rod.

16. The apparatus of claim 15, wherein the muzzle brake comprises a front side and a rear side that is opposite the front side and facing the pistol when the compensator is implemented on the pistol, wherein the first through hole communicatively connects the front side and the second side, wherein the first through hole comprises:

a first front opening on the front size of the muzzle brake; and a first rear opening on the rear size of the muzzle brake, the first rear opening larger than the first front opening and configured to receive a muzzle of a barrel of the pistol when the compensator is implemented on the pistol, wherein the second through hole communicatively connects the front side and the second side, and wherein the second through hole comprises:

a second front opening on the front size of the muzzle brake; and a second rear opening on the rear size of the muzzle brake, the second rear opening smaller than the second front opening and configured to receive the front distal end of the guide rod when the compensator is implemented on the pistol, and wherein a shape of the second rear opening is non-circular.

17. The apparatus of claim 15, further comprising:

a recoil spring received in a slide of the pistol when the compensator is implemented on the pistol and disposed around the guide rod; and a guide rod bushing received in the slide of the pistol when the compensator is implemented on the pistol and disposed around the guide rod, wherein a tip of the rear distal end of the guide rod includes a rear flange such that the recoil spring is compressed between the rear flange and an inner wall of the slide upon firing of a round of ammunition by the pistol, wherein a cross-sectional profile of an opening of the guide rod bushing is non-circular, and wherein the guide rod bushing includes a lug shaped to mate with a bottom surface of the barrel to prevent rotation of the guide rod.

18. The apparatus of claim 15, wherein the returning mechanism comprises a wire, a hydraulic spring, a gas spring, a hydraulic dampener, a gas dampener, a hydraulic piston, or a gas piston.

19. The apparatus of claim 17, wherein a tip of the front distal end of the guide rod includes a flange such that the returning mechanism is compressed between the flange and an inner wall of the second through hole on the rear side of the muzzle brake upon firing of a round of ammunition by the pistol when the compensator is implemented on the pistol.

* * * * *